United States Patent [19]

Fukagai et al.

[11] Patent Number: 4,906,545

[45] Date of Patent: Mar. 6, 1990

[54] ELECTROPHOTOGRAPHIC PHOTOCONDUCTOR WITH UNDERCOAT LAYER CONTAINING METAL OXIDE ON SUPPORT

[75] Inventors: Toshio Fukagai; Kiyoshi Taniguchi; Kayoko Yokoyama, all of Numazu; Katsuichi Ohta, Mishima, all of Japan

[73] Assignee: Ricoh Company, Ltd., Tokyo, Japan

[21] Appl. No.: 244,090

[22] Filed: Sep. 14, 1988

[30] Foreign Application Priority Data

Sep. 14, 1987 [JP] Japan ..... 62-231389
Nov. 2, 1987 [JP] Japan ..... 62-278722

[51] Int. Cl.[4] ..... G03G 5/14

[52] U.S. Cl. ..... 430/58; 430/60; 430/63; 430/65

[58] Field of Search ..... 430/60, 61, 62, 63, 430/58, 57, 65

[56] References Cited

U.S. PATENT DOCUMENTS 3,861,913 1/1975 Chiou ..... 430/58

*Primary Examiner*—J. David Welsh
*Attorney, Agent, or Firm*—Oblon, Spivak, McClelland, Maier & Neustadt

[57] ABSTRACT

An electrophotographic photoconductor is disclosed, which comprises an electroconductive support, an undercoat layer formed on the electroconductive support, comprising at least one metal oxide selected from the group consisting of zirconium oxide, magnesium oxide, calcium oxide, beryllium oxide and lanthanum oxide, and a photoconductive layer comprising a charge generating layer and a charge transporting layer, formed on the undercoat layer.

15 Claims, No Drawings

ELECTROPHOTOGRAPHIC PHOTOCONDUCTOR WITH UNDERCOAT LAYER CONTAINING METAL OXIDE ON SUPPORT

BACKGROUND OF THE INVENTION

The present invention relates to an improved electrophotographic photoconductor.

Recently organic photoconductors are widely used for electrophotographic copying machines of the advantages of low cost, high productivity and non-environment pollution problems over other photoconductors.

Representative examples of organic electrophotographic photoconductors are photoconductive resins such as polyvinylcarbazole (PVK), charge transporting complex type photoconductors, such as PVK-TNF (2,4,6-trinitrofluorenone), pigment-dispersed type photoconductors such as phthalocyanine-binder composition, and function-separation type photoconductors in which a charge generating material and a charge transporting material are used in combination. Among these organic photoconductors, particular attention is paid to the function-separation type photoconductors particularly.

When such a function-separation type photoconductor is applied to the Carlson process, its chargeability is generally not high and its charge retention capability is so poor that the dark decay is large. Furthermore, the chargeability and charge retention capability are considerably degraded while in use, and accordingly the obtained image density becomes non-uniform and decreases while in use of the photoconductor. In particular, in the case of reverse development, toner deposition is apt to take place on the background of the developed images.

Furthermore, such a function-separation type photoconductor has the shortcoming that the chargeability is decreased by the light fatigue prior to exposure. This is probably because the light fatigue prior to exposure is mainly caused by the light absorbed by a charge generating material contained in the photoconductor, so that the longer the period in which the electric charges generated by the light absorption remain in the photoconductor in a movable state, and the greater the number of the generated electric charges, the greater the reduction in chargeability caused by the light fatigue prior to exposure. In other words, even if the photoconductor is charged when the electric charges generated by the light absorption still remain in the photoconductor, the electric charge at the surface of the photoconductor is neutralized by the residual carriers in the photoconductor as they move, so that the surface potential of the photoconductor is not increased until the remaining electric charges are consumed. Therefore, the elevation of the surface potential is delayed by such a period of time that corresponds to the light fatigue prior to exposure.

In order to eliminate the above-mentioned shortcomings, for example, the following undercoat layers have been proposed for use in the conventional electrophotographic photoconductors: intermediate layers comprising nitrocellulose based resins as disclosed in Japanese Laid-Open patent application Nos. 47-6341, 48-3544 and 48-12034; intermediate layers comprising nylon based resins as disclosed in Japanese Laid-Open patent application Nos. 48-47344, 52-25638, 58-30757, 58-63945, 58-95351, 58-98739, and 60-66258; intermediate layers comprising maleic acid based resins as disclosed in Japanese Laid-Open patent application Nos. 49-69332 and 52-10138; and an intermediate layer comprising a polyvinyl alcohol resin as disclosed in Japanese Laid-Open patent application No. 58-105155.

Furthermore, intermediate layers containing various electroconductive additives have been proposed for controlling the electric resistivity thereof, for example, an intermediate layer comprising carbon or chalcogen materials dispersed in a cured resin as disclosed in Japanese Laid-Open patent application No. 51-65942; an intermediate layer comprising a polymer thermally polymerized by use of an isocyanate-type curing agent with addition of a quaternary ammonium salt as disclosed in Japanese Laid-Open patent application No. 52-82238; a resinous intermediate layer with addition of an electric resistivity adjusting agent as disclosed in Japanese Laid-Open patent application No. 55-1180451; a resinous intermediate layer in which aluminum oxide or tin oxide is dispersed as disclosed in Japanese Laid-Open patent application No. 58-58556; a resinous intermediate layer with addition of organic metal compounds as disclosed in Japanese Laid-Open patent application No. 58-93062; resinous intermediate layers with addition of electroconductive particles as disclosed in Japanese Laid-Open patent applications Nos. 58-93063, 60-97363 and 60-111255; a resinous intermediate layer in which magnetite particles are dispersed as disclosed in Japanese Laid-Open patent application No. 59-17557; and resinous intermediate layers in which finely-divided particles of $TiO_2$ and $SnO_2$ are dispersed as disclosed in Japanese Laid-Open patent application Nos. 59-84257, 59-93453 and 60-32054.

The above-mentioned conventional electrophotographic photoconductors, however, still have the shortcomings that the chargeability is decreased while in repeated use, the rising rate of the surface potential at the initial charging is insufficient and the residual potential changes too much for use in practice.

SUMMARY OF THE INVENTION

It is therefore an object of the present invention to provide an electrophotographic photoconductor having high photosensitivity, with a minimum decrease in chargeability as caused by the light fatigue prior to exposure, and no delay in the rising of the surface potential even when it is subjected to a repeated cycle of charge and exposure, and a minimum change in residual potential.

This object of the present invention can be achieved by an electrophotographic photoconductor comprising an electroconductive support, on which an undercoat layer, and a photoconductive layer comprising a charge generating layer and a charge transporting layer are successively overlaid, which undercoat layer comprises at least one metal oxide selected from the group consisting of zirconium oxide, magnesium oxide, calcium oxide, beryllium oxide and lanthanum oxide.

DETAILED DESCRIPTION OF THE PREFERRED EMBODIMENTS

As mentioned above, in the electrophographic photoconductor according to the present invention, an intermediate layer which comprises at least one metal oxide selected from the group consisting of zirconium oxide, magnesium oxide, calcium oxide, beryllium oxide and lanthanum oxide is interposed between an electroconductive support and a photoconductive layer.

As zirconium oxide, pure zirconium oxide and the so-called stabilized or partially stabilized zirconia comprising zirconium oxide and other metal oxides such as yttrium oxide, calcium oxide, magnesium oxide, and cerium oxide in a small amount, for instance, in an amount of 1 to 12 mole % may be employed. The pure zirconium oxide and the zirconia can be employed alone and in combination.

It is preferable that a binder resin be contained in the undercoat layer. As a binder resin for use in the undercoat layer, for instance, thermoplastic resins such as polyamide, polyester, and vinyl chloride-vinyl acetate copolymer, and thermosetting resins prepared by thermally polymerizing (a) compounds having a plurality of active hydrogens (for instance, hydrogen as in —OH group, —$NH_2$ group, and —NH group) and (b) compounds having a plurality of isocyanate groups and/or epoxy groups.

Examples of compounds having a plurality of active hydrogens are acrylic resins having active hydrogens, such as polyvinyl butyral, phenoxy resin, phenol resin, polyamide, polyester, polyethylene glycol, polypropylene glycol, polybutylene glycol, and hydroxyethyl methacrylate. Examples of compounds having a plurality of isocyanate groups are tolylene-diisocyanate, hexamethylenediisocyanate, phenylmethane-diisocyanate, and polymers thereof. An example of a compound having a plurality of epoxy groups is an epoxy resin of Bisphenol A type.

In addition to the above binder resins, there can be employed in the undercoat layer photosetting resins prepared by photopolymerization of resins having unsaturated bonds such as unsaturated polyurethane, and unsaturated polyester, using a photopolymerization initiator such as thioxanthone compounds, and methylbenzyl formate.

It is preferable that the ratio of the amount of the metal oxides to the amount of the binder agent in the undercoat layer be 1:1 to 20:1, more preferably 3:2 to 15:1, in view of the formation of the charge generating layer and the charge transporting layer on the electroconductive support.

It is preferable that the thickness of the undercoat layer be in the range of 0.2 to 20 μm, more preferably in the range of 0.5 to 10 μm, in particular for minimizing the buildup of the residual potential of the photoconductor.

The undercoat layer can be prepared by dissolving or dispersing the above-mentioned components in a solvent and applying the solution or dispersion to an electroconductive support.

As the electroconductive support, it is preferable that the electroconductivity thereof be such that the volume resistivity is $10^{10}$ Ωcm or less, and there can be employed, for instance, (i) a plastic film or drum, and paper, coated with a metal such as aluminum, nickel, chrome, nichrome, copper, silver, gold, platinum, or a metal oxide such as tin oxide and indium oxide, by vacuum deposition or sputtering, (ii) a metal plate made of aluminum, aluminum alloy, nickel or stainless steel, and (iii) a drum made by working the above-mentioned metal plate into a drum by Drawing and Ironing (D.I.), Impact Extrusion and Ironing (I.I.), extruding, or drawing, and cutting the drum, followed by treating the surface thereof by superfinishing or polishing.

In the present invention, the photoconductive layer formed on the above electroconductive support comprises a charge generating layer and a charge transporting layer.

The charge generating layer comprises a charge generating material as the main component, and when necessary a binder agent may be contained.

As the binder agent, for instance, polyamide, polyurethane, polyester, epoxy resin, polyketones, polycarbonate, silicone resin, acrylic resin, polyvinyl butyral, polyvinyl formal, polyvinyl ketone, polystyrene, poly-N-vinylcarbazole, and polyacrylamide can be employed.

As the charge generating material, the following can be employed in the present invention: Organic pigments, such as C.I. Pigment Blue 25 (C.I. 21180), C.I. Pigment Red 41 (C.I. 21200), C.I. Acid Red 52 (C.I. 45100), C.I. Basic Red 3 (C.I. 45210); a phthalocyanine pigment having a porphyrin skeleton; an azulenium salt pigment; a squaric pigment; an azo pigment having a carbazole skeleton (Japanese Laid-Open patent application No. 53-95033), an azo pigment having a styrylstilbene skeleton (Japanese Laid-Open patent application No. 53-138229), an azo pigment having a triphenylamine skeleton (Japanese Laid-Open patent application No. 53-132547), an azo pigment having a dibenzothiophne skeleton (Japanese Laid-Open patent application No. 54-21728), an azo pigment having an oxadiazole skeleton (Japanese Laid-Open patent application No. 54-12742), an azo pigment having a fluorenone skeleton (Japanese Laid-Open patent application No. 54-22834), an azo pigment having a bisstilbene skeleton (Japanese Laid-Open patent application No. 54-17733), an azo pigment having a distyryl oxadiazole skeleton (Japanese Laid-Open patent application No. 54-2129), an azo pigment having a distyryl carbazole skeleton (Japanese Laid-Open patent application No. 54-17734), a trisazo pigment having a carbazole skeleton (Japanese Laid-Open patent application Nos. 57-195767 and 57-195768); phthalocyanine-type pigments such as C.I. Pigment Blue 16 (C.I. 74100); Indigo-type pigments such as C.I. Vat Brown 5 (C.I. 73410) and C.I. Vat Dye (C.I. 73030); and perylene-type pigments such as Algo Scarlet B (made by Violet Co., Ltd.) and indanthrene Scarlet R (made by Bayer Co., Ltd.).

Of the above charge generating materials, the azo pigments are preferably employed in the present invention. The following bisazo pigments and trisazo pigments are more preferably employed in the present invention.

| Pigment No. | A |
|---|---|
| | 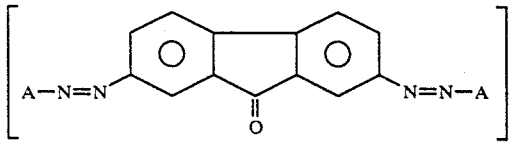 |

-continued
| Pigment No. | A |
|---|---|
| 1 | 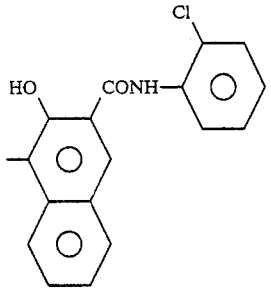 |
| 2 | 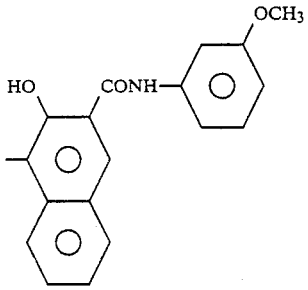 |
| 3 | 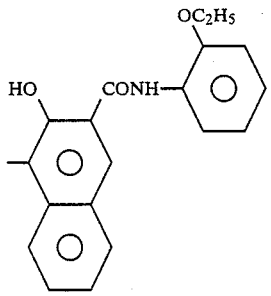 |
| 4 | 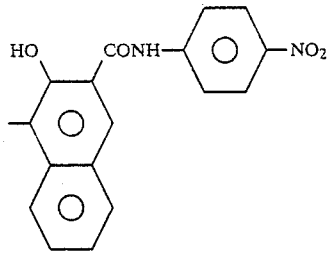 |
| 5 | 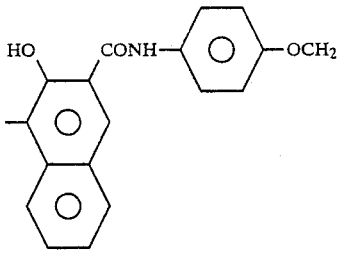 |

-continued
| Pigment No. | A |
|---|---|
| 6 | 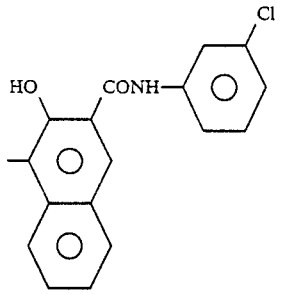 |
| 7 | 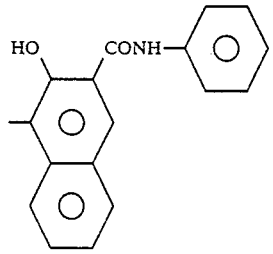 |
| 8 | 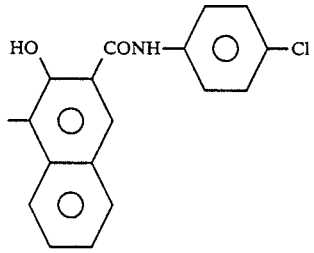 |
| 9 | 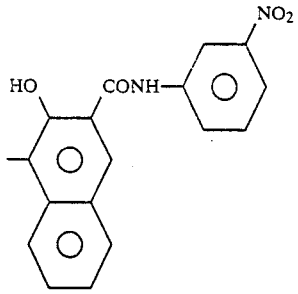 |
| 10 | 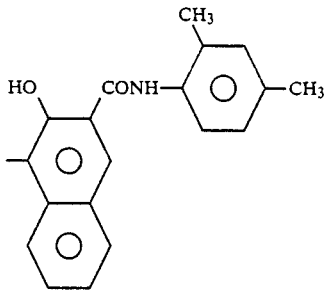 |

-continued
| Pigment No. | A |
|---|---|
| 11 | 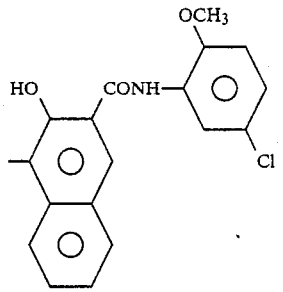 |
| 12 | 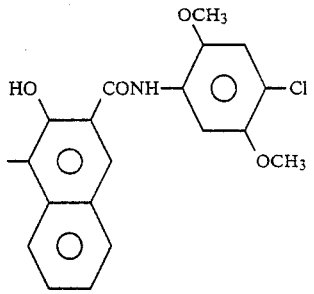 |
| 13 | 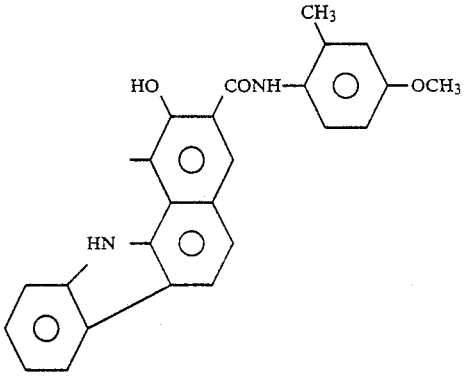 |
| 14 | 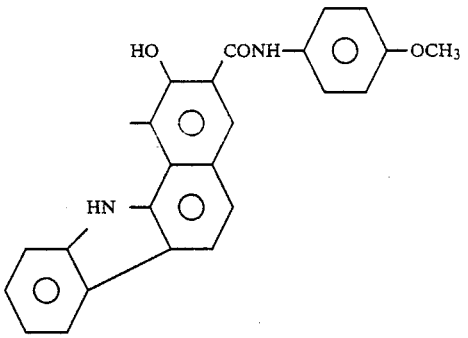 |

-continued
| Pigment No. | A |
|---|---|
| 15 | 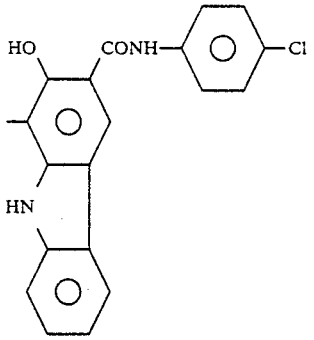 |
| 16 | 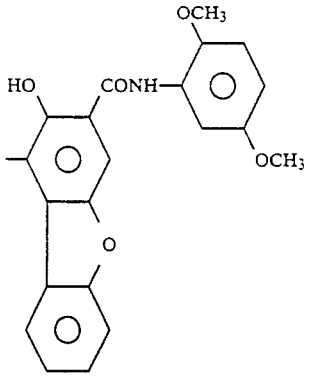 |
| 17 | 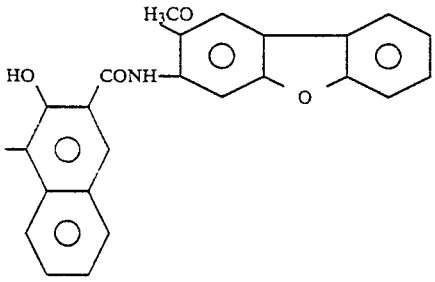 |
| 18 | 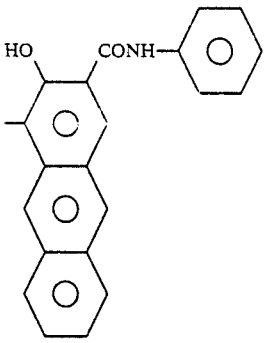 |

-continued
| Pigment No. | A |
|---|---|
| 19 | 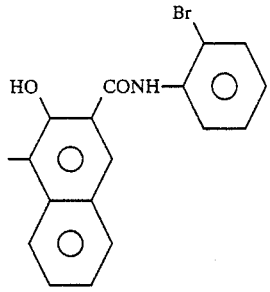 |
| 20 | 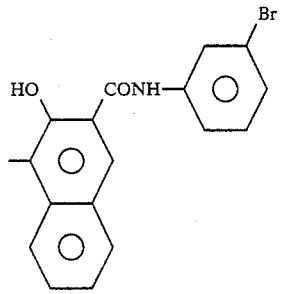 |
| 21 | 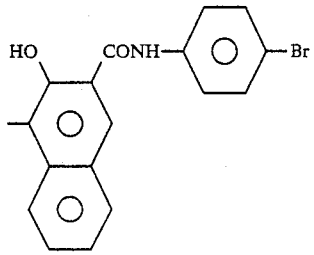 |
| | 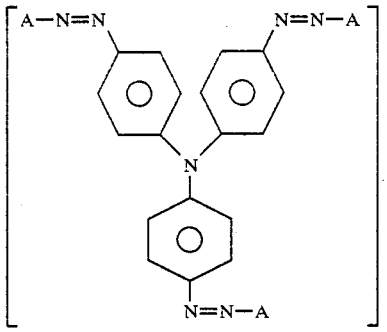 |
| 22 | 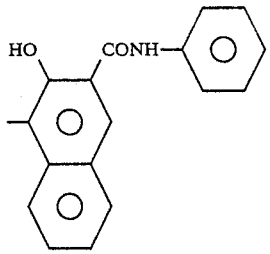 |

-continued
| Pigment No. | A |
|---|---|
| 23 | 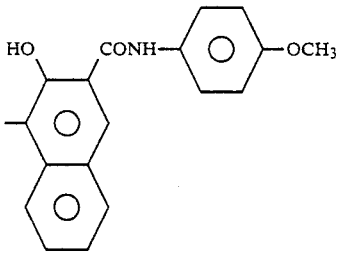 |
| 24 | 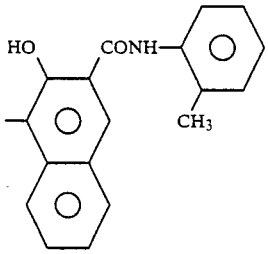 |
| 25 | 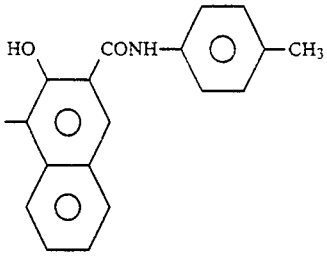 |
| 26 | 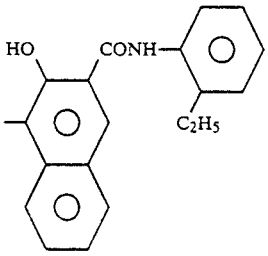 |
| 27 | 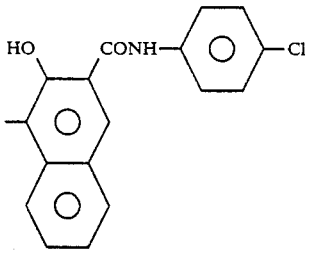 |
| 28 | 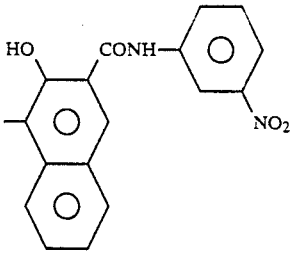 |

-continued
| Pigment No. | A |
|---|---|
| 29 | 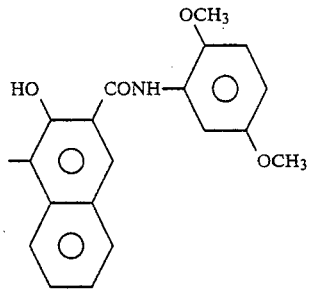 |
| 30 | 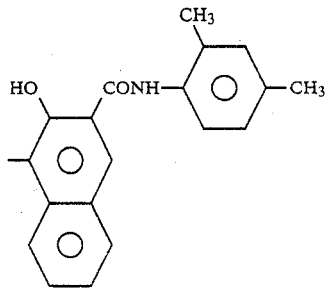 |
| 31 | 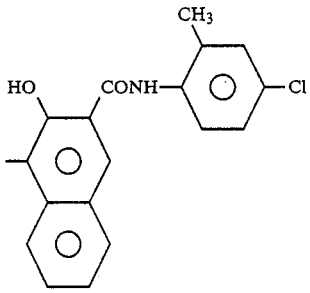 |
| 32 | 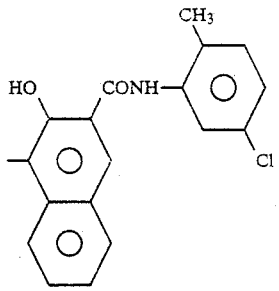 |
| 33 | 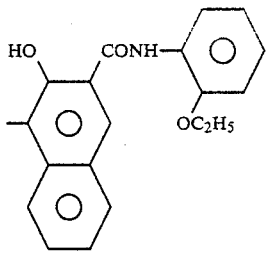 |

-continued
| Pigment No. | A |
|---|---|
| 34 | 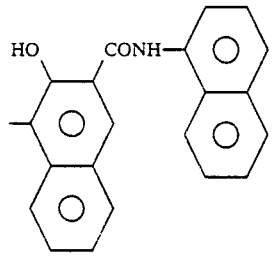 |
| 35 | 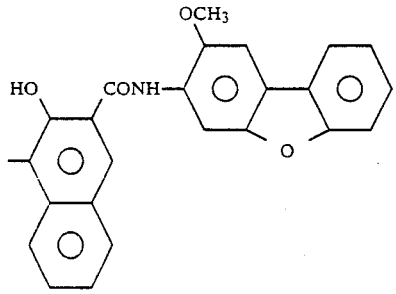 |
| 36 | 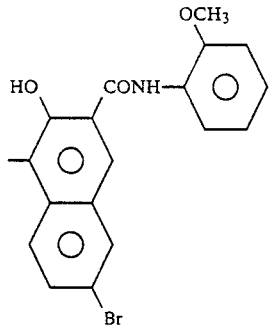 |
| 37 | 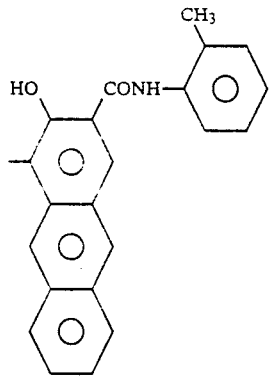 |
| 38 | 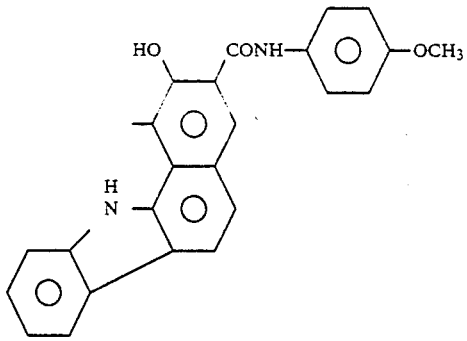 |

-continued
| Pigment No. | A |
|---|---|
| 39 | 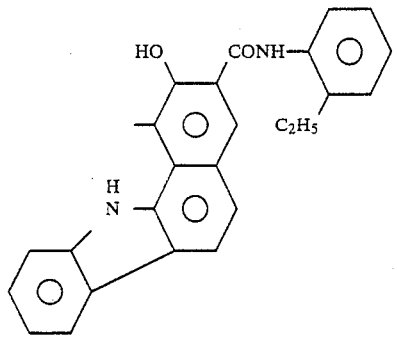 |
| 40 | 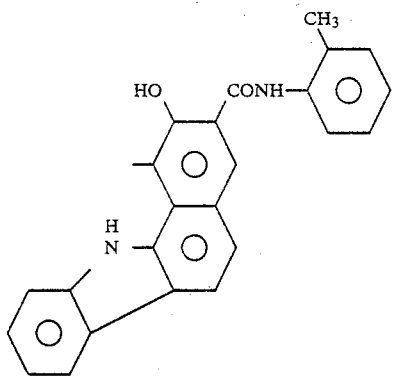 |
| 41 | 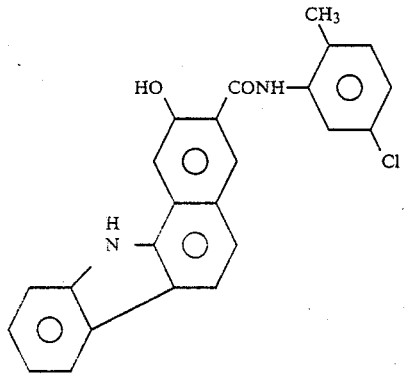 |
| 42 | 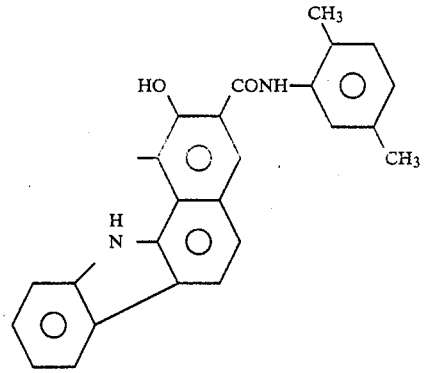 |

-continued
| Pigment No. | A |
|---|---|
| 43 | 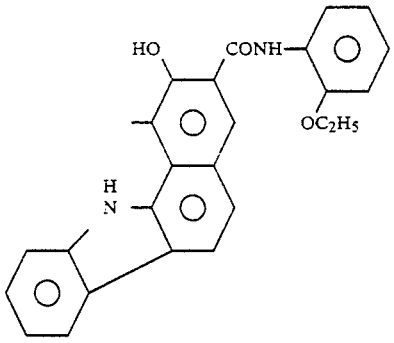 |
| 44 | 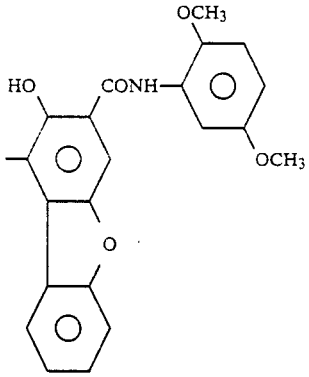 |
| 45 | 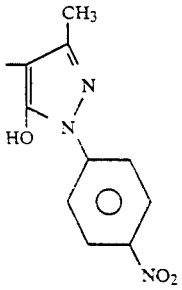 |
| 46 | 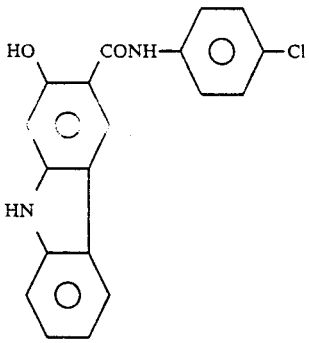 |

-continued
| Pigment No. | A |
|---|---|
| 47 | 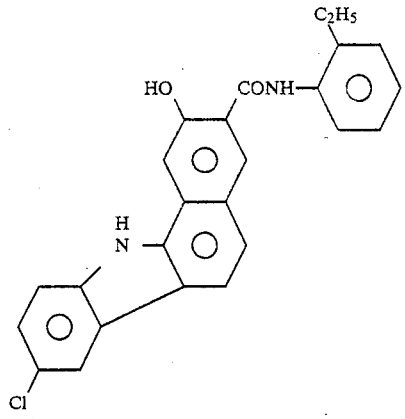 |
| 48 | 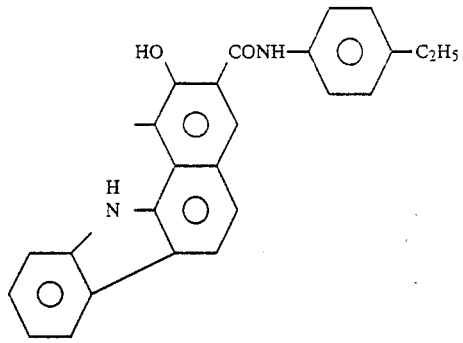 |
| | 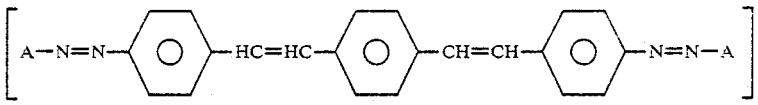 |
| 49 | 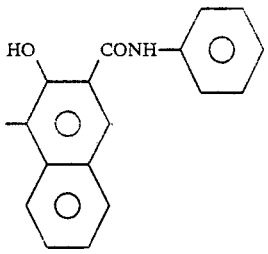 |
| 50 | 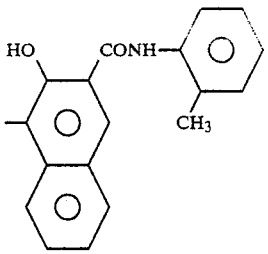 |

-continued
| Pigment No. | A |
|---|---|
| 51 | 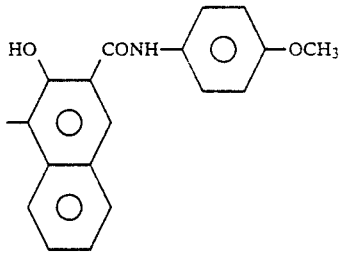 |
| 52 | 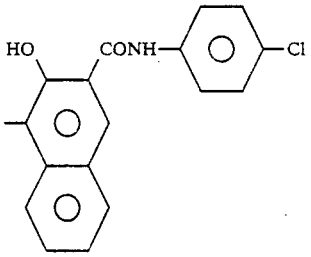 |
| 53 | 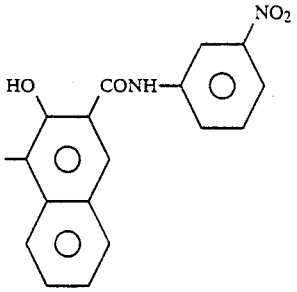 |
| 54 | 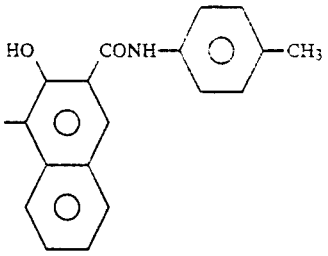 |
| 55 | 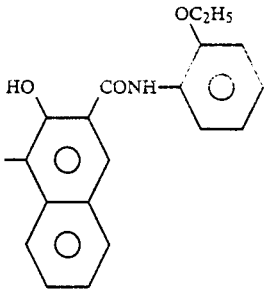 |

-continued
| Pigment No. | A |
|---|---|
| 56 | 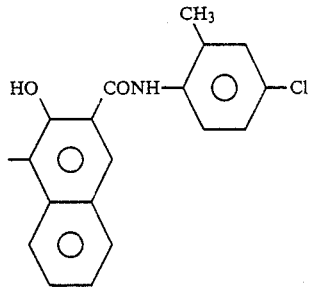 |
| 57 | 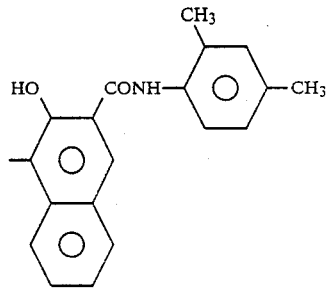 |
| 58 | 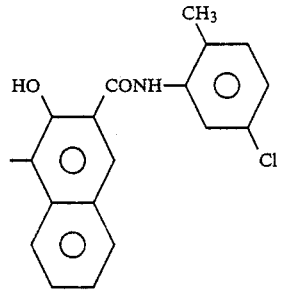 |
| 59 | 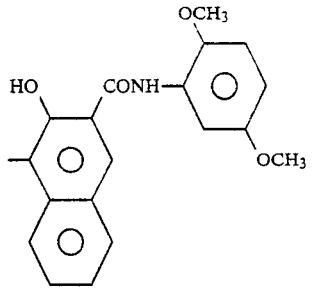 |
| 60 | 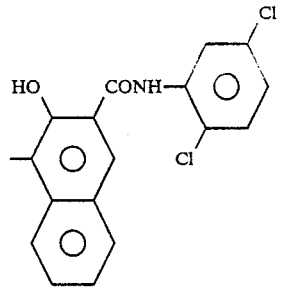 |

-continued
| Pigment No. | A |
|---|---|
| 61 | 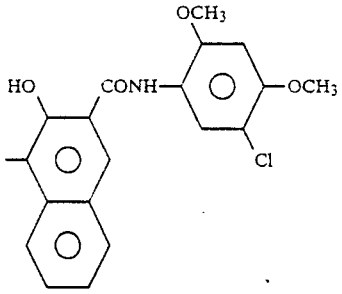 |
| 62 | 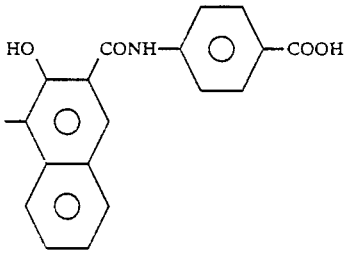 |
| 63 | 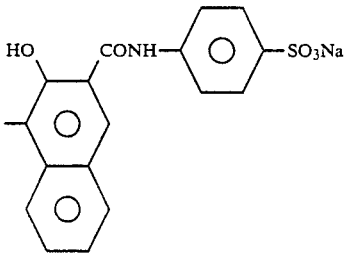 |
| 64 | 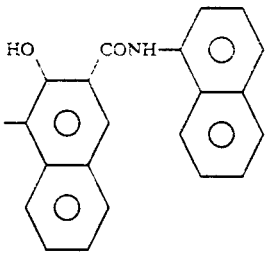 |
| 65 | 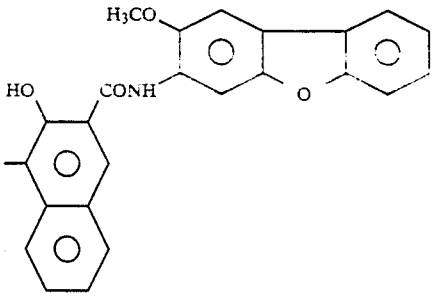 |

-continued
| Pigment No. | A |
|---|---|
| 66 | 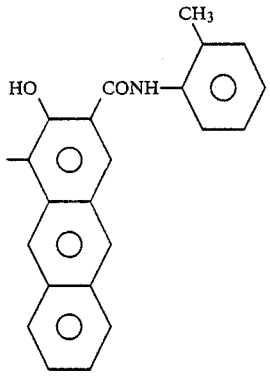 |
| 67 | 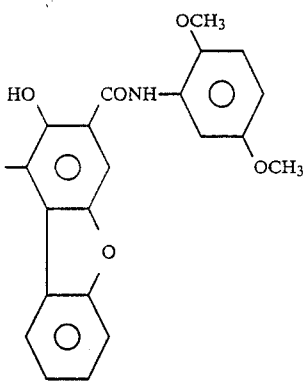 |
| 68 | 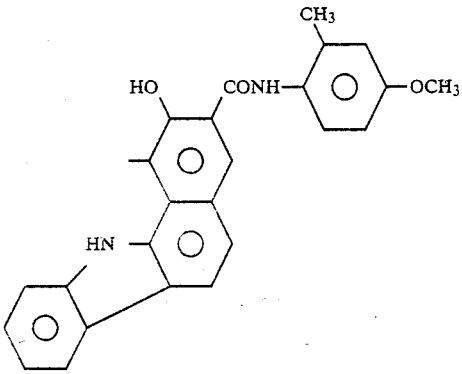 |
| 69 | 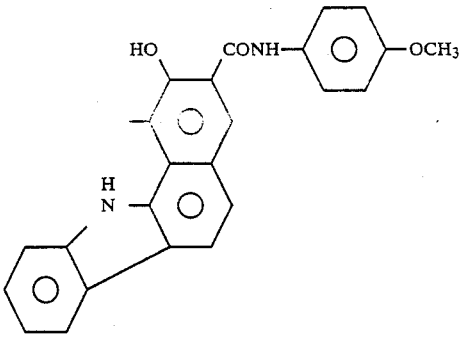 |

-continued

| Pigment No. | A |
|---|---|
| 70 | 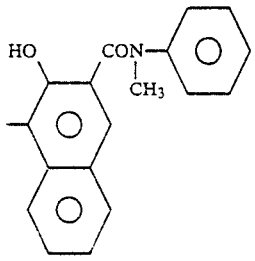 |
| 71 | 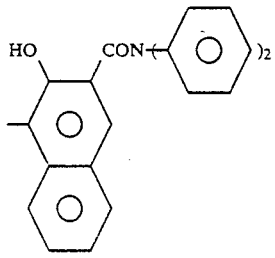 |
| 72 | 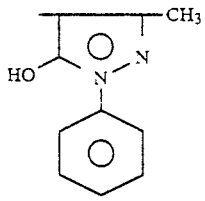 |
| 73 | 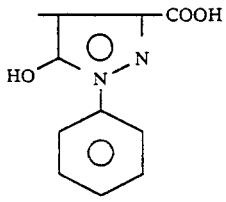 |
| 74 | 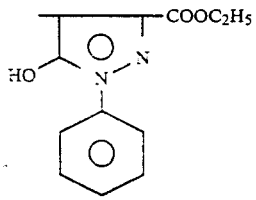 |

The above charge generating materials can be employed alone or in combination.

In the charge generating layer, it is preferable that the previously mentioned binder resins be employed in an amount ranging from 0 to 100 parts by weight, more preferably in an amount ranging from 0 to 50 parts by weight, to 100 parts by weight of the above-mentioned charge generating materials.

The charge generating layer can be formed by (i) dispersing any of the above charge generating materials in a solvent such as tetrahydrofuran, cyclohexanone, dioxane, and chloroethane, when necessary together with a binder agent, in a ball mill, an attritor, or a sand mill, (ii) coating the dispersion with an appropriate dilution when necessary, and (iii) drying the coated dispersion. The coating can be performed by a conventional method such as immersing coating, and spray coating.

It is preferable that the thickness of the charge generating layer be in the range of about 0.01 μm to about 5 μm, more preferably in the range of 0.1 μm to 2 μm.

The charge transporting layer comprises a charge transporting material, and a binder resin when necessary. The charge transporting layer can be formed by dissolving or dispersing the above components in an appropriate solvent and coating the dispersion or solution on the charge generating layer and drying the same.

As the charge transporting material, there are a positive hole transporting material and an electron transporting material.

Specific examples of a positive hole transporting material are poly-N-vinylcarbazole and derivatives thereof, poly-γ-carbazolyl ethyl glutamate and derivatives thereof, pyrene-formaldehyde condensate and derivatives thereof, polyvinyl pyrene, polyvinyl phenanthrene, oxazole derivatives, oxadiazole derivatives, imidazole derivatives, triphenylamine derivatives, 9-(p-diethylaminostyryl)anthracene, 1,1-bis-(4-dibenzylaminophenyl)propane, styryl-anthrancene, styryl pyrazoline, phenylhydrazones, α-phenyl-stilbene derivatives, which are electron doners.

Examples of an electron transporting material are chloroanil, bromoanil, tetracyanoethylene, tetracyanoquinone dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-on, and 1,3,7-trinitrodibenzothiophenone-5,5-dioxide, which are electron acceptors.

These materials can be employed alone or in combination.

In the present invention, when necessary, the following thermoplastic and thermosetting resins can be employed as binder resins: polystyrene, styrene-acrylonintrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyacrylate resin, phenoxy resin, polycarbonate, cellulose acetate resin, ethylcellulose resin, polyvinyl butyral, polyvinyl formal, polyvinyl toluene, poly-N-vinylcarbazole, acrylic resin, silicone resin, epoxy resin, melamine resin, urethane resin, phenolic resin, and alkyd resin.

As the solvent for preparing the coating dispersions of the charge generating layer and the charge transporting layer, tetrahydrofuran, dioxane, toluene, monochlorobenzene, dichloroethane, and methylene chloride can be employed.

It is preferable that the thickness of the charge transporting layer be in the range of about 5 μm to about 100 μm.

In the present invention, a plasticizer and a leveling agent may be added to the charge transporting layer.

As the plasticizer, conventional plasticizers such as dibutyl phthalate and dioctyl phthalate may be employed. It is preferable that such a plasticizer be employed in an amount of 0 to about 30 wt. % to the binder resin in the charge transporting layer. As the leveling agent, silicone oils such as dimethyl silicone oil and methylphenyl silicone oil may be employed. It is preferable that such a leveling agent be employed in an amount of 0 to about 1 wt. % to the binder resin in the charge transporting layer.

Furthermore, in the present invention, an insulating layer and a protective layer may be formed on the photoconductive layer. The overlaying order of the charge generating layer and the charge transporting layer in the photoconductive layer may be reversed.

The present invention will now be explained in detail with reference to the following examples, which are given for illustration of the invention and are not intended to be limiting thereof.

EXAMPLE 1

Preparation of Undercoat Layer Coating Liquid No. 1

In a hard glass pot having a diameter of 9 cm, there were placed alumina sintered balls having a diameter of 1 cm in an amount corresponding to a half of the volume of the glass pot, 17.4 g of finely-divided particles of $ZrO_2$ with a purity of 99.9%, and 61 g of a methyl ethyl ketone solution of a butyral resin (Trademark "BL-1" made by Sekisui Chemical Co., Ltd.) with a solid component concentration of 3.5 wt. %, and the mixture was milled for 24 hours. 9 g of a methyl ethyl ketone solution of tolylene-diisocyanate with a concentration of 7 wt. % was then added to the above mixture and stirred and shaken for about 5 minutes, whereby an undercoat layer coating liquid No. 1 was prepared.

Preparation of Charge Generating Layer Coating Liquid No. 1

In a hard glass pot having a diameter of 15 cm, there were placed alumina sintered balls having a diameter of 1 cm in an amount corresponding to a half of the volume of the glass pot, 300 g of cyclohexanone and 8 g of Azo Pigment No 39, and the mixture was milled for 72 hours. 500 g of cyclohexanone was added to the above mixture. The mixture was then mill for another 24 hours, whereby a charge generating layer coating liquid No. 1 was prepared.

Preparation of Charge Transporting Layer Coating Liquid No. 1

A mixture of the following components was dispersed, whereby a charge transporting layer coating liquid No. 1 was prepared:

| | Parts by Weight |
|---|---|
| 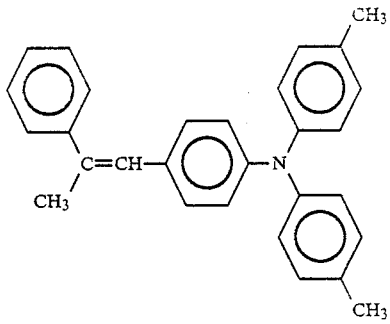 | 10 |
| Polycarbonate (Trademark "Panlite C1400" made by Teijin Kasei Co., Ltd.) | 10 |
| Silicone oil (Trademark "KF-50" made by Shin-Etsu Chemical Co., Ltd.) | 0.0002 |
| Tetrahydrofuran | 80 |

Aluminum was deposited on a polyethylene terephthalate film having a thickness of 75 μm by vacuum deposition, whereby an aluminum-deposited polyethylene terephthalate film was prepared.

Preparation of Electrophotographic Photoconductor No. 1

The undercoat layer coating liquid No. 1 was coated on the aluminum-deposited side of the aluminum-deposited polyethylene terephthalate film by use of a blade, and hardened by drying the coated liquid at 120° C. for 30 minutes, whereby an undercoat layer having a thickness of about 1 μm was formed on the aluminum-deposited polyethylene terephthalate film.

The charge generating layer coating liquid No. 1 was then coated by use of a blade on the undercoat layer and dried at 120° C. for 10 minutes, whereby a charge generating layer having a thickness of about 0.1 μm was formed on the undercoat layer.

Finally the charge transporting layer coating liquid No. 1 was coated by use of a blade on the charge generating layer and dried at 120° C. for 20 minutes, whereby a charge transporting layer having a thickness of about 20 μm was formed on the charge generating layer.

Thus, an electrophotographic photoconductor No. 1 according to the present invention was prepared.

EXAMPLE 2

Preparation of Undercoat Layer Coating Liquid No. 2

In a hard glass pot having a diameter of 9 cm, there were placed alumina sintered balls having a diameter of 1 cm in an amount corresponding to a half of the volume of the glass pot, 7.8 g of finely-divided particles of $ZrO_2$ with a purity of 99.9%, 35 g of a methanol solution of a polyamide resin (Trademark "CM-8000" made by Toray Industries, Inc.) with a solid component concentration of 9 wt. %, and 35 g of n-butanol, and the mixture was milled for 24 hours, whereby an undercoat layer coating liquid No. 2 was prepared.

Example 1 was repeated except that the undercoat layer coating liquid No. 1 employed in Example 1 was replaced by the above undercoat layer coating liquid No. 2, and the coated undercoat layer coating liquid was dried at 120° C. for 10 minutes, whereby an electrophotographic photoconductor No. 2 according to the present invention was prepared.

EXAMPLE 3

Preparation of Undercoat Layer Coating Liquid No. 3

In a hard glass pot having a diameter of 9 cm, there were placed alumina sintered balls having a diameter of 1 cm in an amount corresponding to a half of the volume of the glass pot, 13.3 g of finely-divided particles of $ZrO_2$ with a purity of 99.9%, and 61 g of a methyl ethyl ketone solution of a butyral resin (Trademark "BL-1" made by Sekisui Chemical Co., Ltd.) with a solid component concentration of 4 wt. %, and the mixture was milled for 24 hours. 9 g of a methyl ethyl ketone solution of tolylene-diisocyanate with a concentration of 8 wt. % was then added to the above mixture and stirred and shaken for about 5 minutes, whereby an undercoat layer coating liquid No. 2 was prepared.

Preparation of Charge Generating Layer Coating Liquid No. 2

In a hard glass pot having a diameter of 15 cm, there were placed alumina sintered balls having a diameter of 1 cm in an amount corresponding to a half of the volume of the glass pot, 300 g of a cyclohexanone solution of a polyester resin (Trademark "Vylon 200" made by Toyobo Co., Ltd.) with a concentration of 2.7 wt. % and 8 g of Azo Pigment No. 39, and the mixture was milled for 72 hours. 500 g of methyl ethyl ketone was added to the above mixture. The mixture was then milled for another 24 hours, whereby a charge generating layer coating liquid No. 2 was prepared.

Preparation of Charge Transporting Layer Coating Liquid No. 2

A mixture of the following components was dispersed, whereby a charge transporting layer coating liquid No. 2 was prepared:

| | Parts by Weight |
|---|---|
| 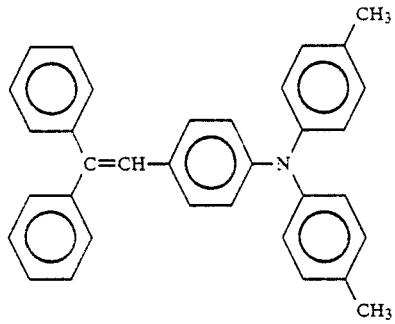 | 10 |
| Polycarbonate (Trademark "Panlite C1400" made by Teijin Kasei Co., Ltd.) | 10 |
| Silicone oil (Trademark "KF-50" made by Shin-Etsu Chemical Co., Ltd.) | 0.0002 |
| Tetrahydrofuran | 80 |

Preparation of Electrophotographic Photoconductor No. 3

The undercoat layer coating liquid No. 3 was coated by use of a blade on the aluminum-deposited side of the same aluminum-deposited polyethylene terephthalate film as that employed in Example 1, and hardened by drying the coated liquid at 120° C. for 30 minutes, whereby an undercoat layer having a thickness of about 1 μm was formed on the aluminum-deposited polyethylene terephthalate film.

The charge generating layer coating liquid No. 2 was then coated by use of a blade on the undercoat layer and dried at 120° C. for 10 minutes, whereby a charge generating layer having a thickness of about 0.1 μm was formed on the undercoat layer.

Finally the charge transporting layer coating liquid No. 2 was coated by use of a blade on the charge generating layer and dried at 120° C. for 20 minutes, whereby a charge transporting layer having a thickness of about 20 μm was formed on the charge generating layer.

Thus, an electrophotographic photoconductor No. 3 according to the present invention was prepared.

EXAMPLE 4

Example 3 was repeated except that the charge generating layer coating liquid No. 2 employed in Example 3 was replaced by a charge generating layer coating liquid No. 3, which was prepared by replacing Azo Pigment No. 39 in the charge generating layer coating liquid No. 2 by Azo Pigment No. 57, and that the charge transporting layer coating liquid No. 2 employed in Example 3 was replaced by the charge transporting layer coating liquid No. 1 employed in Example 1, whereby an electrophotographic photoconductor No. 4 according to the present invention was prepared.

EXAMPLE 5

Example 3 was repeated except that the undercoat layer coating liquid No. 3 employed in Example 3 was replaced by the following undercoat layer coating liquid No. 4, whereby an electrophotographic photoconductor No. 5 according to the present invention was prepared.

Preparation of Undercoat Layer Coating Liquid No. 4

In a hard glass pot having a diameter of 9 cm, there were placed alumina sintered balls having a diameter of 1 cm in an amount corresponding to a half of the volume of the glass pot, 13.3 g of finely-divided particles of $ZrO_2.Y_2O_3$ with a purity of 99.9%, which was prepared by stabilizing $ZrO_2$ with a purity of 99.9 by 10.1 wt. % of $Y_2O_3$, and 61 g of a methyl ethyl ketone solution of butyral resin (Trademark "BL-1" made by Sekisui Chemical Co., Ltd) with a solid component concentration of 4 wt. %, and the mixture was milled for 24 hours. 9 g of a methyl ethyl ketone solution of tolylenediisocyanate with a concentration of 8 wt. % was then added to the above mixture and stirred and shaken for about 5 minutes, whereby the undercoat layer coating liquid No. 4 was prepared.

Comparative Example 1

Example 1 was repeated except that the undercoat layer formed in Example 1 was not provided, whereby a comparative electrophotographic photoconductor No. 1 was prepared.

Comparative Example 2

Example 1 was repeated except that the undercoat layer coating liquid No. 1 employed in Example 1 was replaced by a comparative undercoat layer coating liquid No. 1 with the following formulation, whereby a comparative electrophotographic photoconductor No. 2 was prepared.

Comparative Undercoat Layer Coating Liquid No. 1

| | Parts by Weight |
|---|---|
| Butyral resin (Trademark "BL-1" made by Sekisui Chemical Co., Ltd.) | 6 |
| Tolylenediisocyanate | 2 |
| Methyl ethyl ketone | 92 |

Comparative Example 3

Example 1 was repeated except that the undercoat layer coating liquid No. 1 employed in Example 1 was replaced by a comparative undercoat layer coating liquid No. 2, which was prepared by replacing 17.4 g of finely-divided particles of $ZrO_2$ with a purity of 99.9% in the undercoat layer coating liquid No. 1 employed in Example 1 with 17.7 g of finely-divided titanium oxide (Trademark "Tipaque R680" made by Ishihara Sangyo Kaisha, Ltd.), whereby a comparative electrophotographic photoconductor No. 3 was prepared.

Comparative Example 4

Example 2 was repeated except that the undercoat layer coating liquid No. 2 employed in Example 2 was replaced by a comparative undercoat layer coating liquid No. 3 with the following formulation, whereby a comparative electrophotographic photoconductor No. 4 was prepared.

Comparative Undercoat Layer Coating Liquid No. 3

| | Parts by Weight |
|---|---|
| Polyamide resin (Trademark "CM8000" made by Toray Industries, Inc.) | 8 |
| Methanol | 46 |
| n-butanol | 46 |

Comparative Example 5

Example 3 was repeated except that the undercoat layer formed in Example 3 was not provided, whereby a comparative electrophotographic photoconductor No. 5 was prepared.

Comparative Example 6

Example 4 was repeated except that the undercoat layer formed in Example 4 was not provided, whereby a comparative electrophotographic photoconductor No. 6 was prepared.

Each of the thus prepared electrophotographic photoconductors No. 1 through No. 5 according to the present invention and the comparative electrophotographic photoconductors No. 1 through No. 6 was charged negatively in the dark under application of −6 kV of corona charge for 20 seconds, during which corona charging, the surface potential ($V_2$) of each photoconductor 2 seconds after the initiation of the charging was measured. Each photoconductor was then illuminated by a tungsten lamp of 2856° K. in such a manner that the illuminance on the illuminated surface of the photoconductor was 20 lux.sec, so that the surface potential $V_R$ (residual potential) of the photoconductor was measured.

Each photoconductor was again charged to a surface potential of −800 V and exposed to the light of the above-mentioned tungsten lamp until the surface potential was decreased to −400 V, so that the exposure (S) necessary for this decrease of the surface potential was measured. The above measurement was performed by use of a commercially available electrostatic copying sheet test apparatus ("Model SP-428" made by Kawaguchi Electro Works).

Furthermore, in order to assess the fatigue characteristics of the photoconductors, each photoconductor was subjected to a −7 kV charging and a 30 lux exposure alternatively, each lasting for 3 hours, so that $V'_2$, $V'_R$, and S' were measured by using the same apparatus as mentioned above.

The results are shown in Table 1.

TABLE 1

| | Charge Generating Layer | Undercoat Layer (Metal Oxide/Binder Ratio) | | Before Fatigue | | | After Fatigue | | |
|---|---|---|---|---|---|---|---|---|---|
| | Azo pigment No. | Weight Ratio | Volume Ratio | $V_2$ | $V_R$ | S | $V'_2$ | $V'_R$ | S' |
| Example 1 | 39 | 8/1 | 1.5/1 | −890 | −7 | 0.44 | −860 | −12 | 0.43 |
| Example 2 | 39 | 2.5/1 | 1/2 | −910 | −8 | 0.49 | −915 | −12 | 0.43 |
| Example 3 | 39 | 5/1 | 1/1 | −885 | −5 | 0.43 | −775 | −5 | 0.41 |
| Example 4 | 57 | 5/1 | 1/1 | −920 | −23 | 0.66 | −840 | −26 | 0.65 |
| Example 5 | 39 | 5/1 | 1/1 | −905 | −10 | 0.46 | −830 | −8 | 0.44 |
| Comparative Example 1 | 39 | no undercoat layer | — | −720 | 0 | 0.46 | −470 | −5 | * |
| Comparative Example 2 | 39 | 0/1 | 0/1 | −870 | −130 | 0.60 | −720 | −165 | 0.68 |
| Comparative Example 3 | 39 | 6.4/1 | 1.5/1 | −830 | −20 | 0.47 | −690 | −55 | 0.49 |

TABLE 1-continued

| | Charge Generating Layer | Undercoat Layer (Metal Oxide/Binder Ratio) | | Before Fatigue | | | After Fatigue | | |
|---|---|---|---|---|---|---|---|---|---|
| | Azo pigment No. | Weight Ratio | Volume Ratio | $V_2$ | $V_R$ | S | V'2 | $V'_R$ | S' |
| Comparative Example 4 | 39 | 0/1 | 0/1 | −840 | −10 | 0.52 | −700 | −35 | 0.57 |
| Comparative Example 5 | 39 | no undercoat layer | — | −680 | 0 | 0.42 | −390 | 0 | * |
| Comparative Example 6 | 57 | no undercoat layer | — | −790 | −2 | 0.64 | −420 | −15 | * |

*Unmeasurable because charging up to −800 V was impossible.

EXAMPLE 6

Preparation of Undercoat Layer Coating Liquid No. 5

In a hard glass pot having a diameter of 9 cm, there were placed alumina sintered balls having a diameter of 1 cm in an amount corresponding to a half of the volume of the glass pot, 15.2 g of finely-divided particles of magnesium oxide with a purity of 99.99%, and 61 g of a methyl ethyl ketone solution of a butyral resin (Trademark "BL-1" made by Sekisui Chemical Co., Ltd.) with a solid component concentration of 3.5 wt. %. and the mixture was milled for 24 hours. 9 g of a methyl ethyl ketone solution of tolylene-diisocyanate with a concentration of 7 wt. % was then added to the above mixture and stirred and shaken for about 5 minutes, whereby an undercoat layer coating liquid No. 5 was prepared.

Preparation of Charge Generating Layer Coating Liquid No. 4

In a hard glass pot having a diameter of 15 cm, there were placed alumina sintered balls having a diameter of 1 cm in an amount corresponding to a half of the volume of the glass pot, 300 g of cyclohexanone and 8 g of Azo Pigment No. 1, and the mixture was milled for 72 hours. 500 g of cyclohexanone was added to the above mixture. The mixture was then mill for another 24 hours, whereby a charge generating layer coating liquid No. 4 was prepared.

Preparation of Electrophotographic Photoconductor No. 6

The undercoat layer coating liquid No. 5 was coated on the same aluminum-deposited side of the aluminum-deposited polyethylene terephthalate film that was employed in Example 1 by use of a blade, and hardened by drying the coated liquid at 120° C. for 30 minutes, whereby an undercoat layer having a thickness of about 1 μm was formed on the aluminum-deposited polyethylene terephthalate film.

The charge generating layer coating liquid No. 4 was then coated by use of a blade on the undercoat layer and dried at 120° C. for 10 minutes, whereby a charge generating layer having a thickness of about 0.1 μm was formed on the undercoat layer.

Finally the same charge transporting layer coating liquid No. 1 as that employed in Example 1 was coated by use of a blade on the charge generating layer and dried at 120° C. for 20 minutes, whereby a charge transporting layer having a thickness of about 20 μm was formed on the charge generating layer.

Thus, an electrophotographic photoconductor No. 6 according to the present invention was prepared.

EXAMPLE 7

Example 6 was repeated except that the undercoat layer coating liquid No. 5 employed in Example 6 was replaced by an undercoat layer coating liquid No. 6 which was prepared as follows, and that the coated undercoat layer coating liquid was dried at 120° C. for 10 minutes, whereby an electrophotographic photoconductor No. 7 according to the present invention was prepared.

Preparation of Undercoat Layer Coating Liquid No. 6

In a hard glass pot having a diameter of 9 cm, there were placed alumina sintered balls having a diameter of 1 cm in an amount corresponding to a half of the volume of the glass pot, 5.7 g of finely-divided particles of magnesium oxide with a purity of 99.99%, 35 g of a methanol solution of polyamide resin (Trademark "CM-8000" made by Toray Industries, Inc.) with a solid component concentration of 9 wt. %, and 35 g of n-butanol, and the mixture was milled for 24 hours, whereby the undercoat layer coating liquid No. 6 was prepared.

EXAMPLE 8

Preparation of Undercoat Layer Coating Liquid No. 7

In a hard glass pot having a diameter of 9 cm, there were placed alumina sintered balls having a diameter of 1 cm in an amount corresponding to a half of the volume of the glass pot, 11.5 g of finely-divided particles of magnesium oxide with a purity of 99.99%, and 61 g of a methyl ethyl ketone solution of butyral resin (Trademark "BL-1" made by Sekisui Chemical Co., Ltd.) with a solid component concentration of 4 wt. %, and the mixture was milled for 24 hours. 9 g of a methyl ethyl ketone solution of tolylene-diisocyanate with a concentration of 8 wt. % was then added to the above mixture and stirred and shaken for about 5 minutes, whereby an undercoat layer coating liquid No. 7 was prepared.

The undercoat layer coating liquid No. 7 was coated by use of a blade on the aluminum-deposited side of the same aluminum-deposited polyethylene terephthalate film as that employed in Example 1, and hardened by drying the coated liquid at 120° C. for 10 minutes, whereby an undercoat layer having a thickness of about 1 μm was formed on the aluminum-deposited polyethylene terephthalate film.

The charge generating layer coating liquid No. 2 which was employed in Example 3 was then coated by use of a blade on the undercoat layer and dried at 120° C. for 10 minutes, whereby a charge generating layer having a thickness of about 0.1 μm was formed on the undercoat layer.

Finally the charge transporting layer coating liquid No. 2 which was also employed in Example 3 was coated by use of a blade on the charge generating layer and dried at 120° C. for 20 minutes, whereby a charge transporting layer having a thickness of about 20 μm was formed on the charge generating layer.

Thus, an electrophotograhic photoconductor No. 8 according to the present invention was prepared.

EXAMPLE 9

Example 6 was repeated except that the undercoat layer coating liquid No. 5 employed in Example 6 was replaced by an undercoat layer coating liquid No. 8, which was prepared by replacing 15.2 g of finely-divided magnesium oxide in the undercoat layer coating liquid No. 5 employed in Example 6 by 14.1 g of finely-divided calcium oxide with a purity of 99.99%, whereby an electrophotographic photoconductor No. 9 according to the present invention was prepared.

EXAMPLE 10

Example 7 was repeated except that the undercoat layer coating liquid No. 6 employed in Example 7 was replaced by an undercoat layer coating liquid No. 9, which was prepared by replacing 5.7 g of finely-divided magnesium oxide in the undercoat layer coating liquid No. 6 employed in Example 7 by 5.4 g of finely-divided calcium oxide with a purity of 99.99%, whereby an electrophotographic photoconductor No. 10 according to the present invention was prepared.

EXAMPLE 11

Example 8 was repeated except that the undercoat layer coating liquid No. 7 employed in Example 8 was replaced by an undercoat layer coating liquid No. 10, which was prepared by replacing 11.5 g of finely-divided magnesium oxide in the undercoat layer coating liquid No. 7 employed in Example 8 by 10.5 g of finely-divided calcium oxide with a purity of 99.99%, whereby an electrophotographic photoconductor No. 11 according to the present invention was prepared.

EXAMPLE 12

Example 6 was repeated except that the undercoat layer coating liquid No. 5 employed in Example 6 was replaced by an undercoat layer coating liquid No. 11, which was prepared by replacing 15.2 g of finely-divided magnesium oxide in the undercoat layer coating liquid No. 5 employed in Example 6 by 12.5 g of finely-divided beryllium oxide with a purity of 99.99%, whereby an electrophotographic photoconductor No. 12 according to the present invention was prepared.

EXAMPLE 13

Example 7 was repeated except that the undercoat layer coating liquid No. 6 employed in Example 7 was replaced by an undercoat layer coating liquid No. 12, which was prepared by replacing 5.7 g of finely-divided magnesium oxide in the undercoat layer coating liquid No. 6 employed in Example 7 by 4.7 g of finely-divided beryllium oxide with a purity of 99.99%, whereby an electrophotographic photoconductor No. 13 according to the present invention was prepared.

EXAMPLE 14

Example 8 was repeated except that the undercoat layer coating liquid No. 7 employed in Example 8 was replaced by an undercoat layer coating liquid No. 13, which was prepared by replaced 11.5 g of finely-divided magnesium oxide in the undercoat layer coating liquid No. 7 employed in Example 8 by 9.3 g of finely-divided beryllium oxide with a purity of 99.99%, whereby an electrophotographic photoconductor No. 14 according to the present invention was prepared.

EXAMPLE 15

Example 6 was repeated except that the undercoat layer coating liquid No. 5 employed in Example 6 was replaced by an undercoat layer coating liquid No. 14, which was prepared by replacing 15.2 g of finely-divided magnesium oxide in the undercoat layer coating liquid No. 5 employed in Example 6 by 27.1 g of finely-divided lanthanum oxide with a purity of 99.99%, whereby an electrophotographic photoconductor No. 15 according to the present invention was prepared.

EXAMPLE 16

Example 7 was repeated except that the undercoat layer coating liquid No. 6 employed in Example 7 was replaced by an undercoat layer coating liquid No. 15, which was prepared by replacing 5.7 g of finely-divided magnesium oxide in the undercoat layer coating liquid No. 6 employed in Example 7 by 10.4 g of finely-divided lanthanum oxide with a purity of 99.99%, whereby an electrophotographic photoconductor No. 16 according to the present invention was prepared.

EXAMPLE 17

Example 8 was repeated except that the undercoat layer coating liquid No. 7 employed in Example 8 was replaced by an undercoat layer coating liquid No. 16, which was prepared by replacing 11.5 g of finely-divided magnesium oxide in the undercoat layer coating liquid No. 7 employed in Example 8 by 20.2 g of finely-divided lanthanum oxide with purity of 99.99%, whereby an electrophotographic photoconductor No. 17 according to the present invention was prepared.

Comparative Example 7

Example 6 was repeated except that the undercoat layer formed in Example 6 was not provided, whereby a comparative electrophotographic photoconductor No. 7 was prepared.

Comparative Example 8

Example 6 was repeated except that the undercoat layer coating liquid No. 5 employed in Example 6 was replaced by the comparative undercoat layer coating liquid No. 1 which was employed in Comparative Example 2 with the following formulation, whereby a comparative electrophotographic photoconductor No. 8 was prepared.

Comparative Undercoat Layer Coating Liquid No. 1

| | Parts by Weight |
|---|---|
| Butyral resin (Trademark "BL-1" made by Sekisui Chemical Co., Ltd.) | 6 |
| Tolylenediisocyanate | 2 |
| Methyl ethyl ketone | 92 |

Comparative Example 9

Example 6 was repeated except that the undercoat layer coating liquid No. 5 employed in Example 6 was replaced by a comparative undercoat layer coating liquid No. 4, which was prepared by replacing 15.2 g of finely-divided particles of magnesium oxide with a purity of 99.9% in the undercoat layer coating liquid No. 5 employed in Example 6 with 17.7 g of finely-divided titanium oxide (Trademark "Tipaque R680" made by Ishihara Sangyo Kaisha, Ltd.), whereby a comparative electrophotographic photoconductor No. 9 was prepared.

Comparative Example 10

Example 7 was repeated except that the undercoat layer coating liquid No. 6 employed in Example 7 was replaced by the comparative undercoat layer coating liquid No. 3 which was employed in Comparative Example 4 with the following formulation, whereby a comparative electrophotographic photoconductor No. 10 was prepared.

Comparative Undercoat Layer Coating Liquid No. 3

| | Parts by Weight |
|---|---|
| Polyamide resin (Trademark "CM8000" made by Toray Industries, Inc.) | 8 |
| Methanol | 46 |
| n-butanol | 46 |

Comparative Example 11

Example 8 was repeated except that the undercoat layer formed in Example 8 was not provided, whereby a comparative electrophotographic photoconductor No. 11 was prepared.

Each of the thus prepared electrophotographic photoconductors No. 6 through No. 17 according to the present invention and the comparative electrophotographic photoconductors No. 7 through No. 11 was charged negatively in the dark under application of −6 kV of corona charge for 20 seconds, during which corona charging, the surface potential ($V_2$) of each photoconductor 2 seconds after the initiation of the charging was measured. Each photoconductor was then illuminated by a tungsten lamp of 2856° K. in such a manner that the illuminance on the illuminated surface of the photoconductor was 20 lux.sec, so that the surface potentially $V_R$ (residual potential) of the photoconductor was measured.

Each photoconductor was again charged to a surface potential of −800 V and exposed to the light of the above-mentioned tungsten lamp until the surface potential was decreased to −400 V, so that the exposure (S) necessary for this decrease of the surface potential was measured. The above measurement was performed by use of a commercially available electrostatic copying sheet test apparatus (Model SP-428 made by Kawaguchi Electro Works).

Furthermore, in order to the fatigue characteristics of the photoconductors, each photoconductor was subjected to a −7 kV charging and a 30 lux exposure alternatively, each lasting for 3 hours, so that $V'_2$, $V'_R$, and S' were measured by using the same apparatus as mentioned above.

The results are shown in Table 2.

TABLE 2

| | Charge Generating Layer | Undercoat Layer (Metal Oxide/Binder Ratio) | | Before Fatigue | | | After Fatigue | | |
|---|---|---|---|---|---|---|---|---|---|
| | Azo pigment No. | Weight Ratio | Volume Ratio | $V_2$ | $V_R$ | S | $V'_2$ | $V'_R$ | S' |
| Example 6 | 1 | 5.5/1 | approx. 1.5/1 | −900 | −22 | 0.54 | −860 | −30 | 0.56 |
| Example 7 | 1 | 1.8/1 | approx. 1/2 | −840 | 0 | 0.59 | −800 | −9 | 0.61 |
| Example 8 | 39 | 3.7/1 | approx. 1/1 | −860 | −16 | 0.49 | −730 | −19 | 0.45 |
| Example 9 | 1 | 5.1/1 | approx. 1.5/1 | −860 | −14 | 0.60 | −840 | −12 | 0.62 |
| Example 10 | 1 | 1.7/1 | approx. 1/2 | −870 | 0 | 0.61 | −840 | −6 | 0.62 |
| Example 11 | 39 | 3.4/1 | approx. 1/1 | −850 | −10 | 0.52 | −700 | −11 | 0.49 |
| Example 12 | 1 | 4.5/1 | approx. 1.5/1 | −930 | −26 | 0.46 | −860 | −21 | 0.48 |
| Example 13 | 1 | 1.5/1 | approx. 1/2 | −880 | 0 | 0.49 | −840 | −6 | 0.52 |
| Example 14 | 39 | 3/1 | approx. 1/1 | −830 | −20 | 0.44 | −700 | −13 | 0.42 |
| Example 15 | 1 | 9.8/1 | approx. 1.5/1 | −940 | −14 | 0.47 | −890 | −21 | 0.49 |
| Example 16 | 1 | 3.3/1 | approx. 1/2 | −890 | 0 | 0.52 | −850 | −12 | 0.54 |
| Example 17 | 39 | 6.5/1 | approx. 1/1 | −870 | −10 | 0.46 | −720 | −14 | 0.42 |
| Comparative Example 7 | 1 | no undercoat layer | — | −870 | 0 | 0.48 | −730 | −23 | 0.51 |
| Comparative Example 8 | 1 | 0/1 | 0/1 | −920 | −120 | 0.62 | −850 | −150 | 0.73 |
| Comparative Example 9 | 1 | 6.4/1 | approx. 1.5/1 | −840 | −10 | 0.51 | −510 | −38 | 0.57 |
| Comparative Example 10 | 1 | 0/1 | 0/1 | −850 | 0 | 0.59 | −780 | −45 | 0.66 |
| Comparative Example 11 | 39 | no undercoat layer | — | −680 | 0 | 0.42 | −390 | *0 | * |

*Unmeasurable because charging up to −800 V was impossible.

What is claimed is:

1. An electrophotographic photoconductor comprising: an electroconductive support, an undercoat layer formed on said electroconductive support, comprising at least one metal oxide selected from the group consisting of zirconium oxide, magnesium oxide, calcium oxide, beryllium oxide and lanthanum oxide, and a photoconductive layer comprising a charge generating layer and a charge transporting layer, formed on said undercoat layer.

2. The electrophotographic photoconductor as claimed in claim 1, wherein said undercoat layer further comprises a binder resin.

3. The electrophotographic photoconductor as claimed in claim 2, wherein said binder resin is a thermoplastic resin.

4. The electrophotographic photoconductor as claimed in claim 2, wherein said binder resin is a thermosetting resin.

5. The electrophotographic photoconductor as claimed in claim 2, wherein the ratio of the amount of said metal oxide to the amount of said binder resin is in the range of (1:1) to (20:1) by weight.

6. The electrophotographic photoconductor as claimed in claim 2, wherein the ratio of the amount of said metal oxide to the amount of said ratio binder resin is in the range of (3:2) to (15:1).

7. The electrophotographic photoconductor as claimed in claim 1, wherein said undercoat layer has a thickness ranging from 0.2 μm to 20 μm.

8. The electrophotographic photoconductor as claimed in claim 7, wherein said undercoat layer has a thickness ranging from 0.5 μm to 10 μm.

9. An electrophotographic photoconductor comprising: an electroconductive support, an undercoat layer formed on said electroconductive support, comprising zirconium oxide, and a photoconductive layer comprising a charge generating layer and a charge transporting layer, formed on said undercoat layer.

10. The electrophotographic photoconductor as claimed in claim 9, wherein said zirconium oxide further comprises at least one additional metal oxide selected from the group consisting of yttrium oxide, calcium oxide, magnesium oxide, and cerium oxide.

11. The electrophotographic photoconductor as claimed in claim 10, wherein the amount of said additional metal oxide is in a range of 1 to 12 mole % to the total of said zirconium oxide and said additional metal oxide.

12. An electrophotographic photoconductor comprising: an electroconductive support, an undercoat layer formed on said electroconductive support, comprising magnesium oxide, and a photoconductive layer comprising a charge generating layer and a charge transporting layer, formed on said undercoat layer.

13. An electrophotographic photoconductor comprising: an electroconductive support, an undercoat layer formed on said electroconductive support, comprising calcium oxide, and a photoconductive layer comprising a charge generating layer and a charge transporting layer, formed on said undercoat layer.

14. An electrophotographic photoconductor comprising: an electroconductive support, an undercoat layer formed on said electroconductive support, comprising beryllium oxide, and a photoconductive layer comprising a charge generating layer and a charge transporting layer, formed on said undercoat layer.

15. An electrophotographic photoconductor comprising: an electroconductive support, an undercoat layer formed on said electroconductive support, comprising lanthanum oxide, and a photoconductive layer comprising a charge generating layer and a charge transporting layer, formed on said undercoat layer.

* * * * *

UNITED STATES PATENT AND TRADEMARK OFFICE

CERTIFICATE OF CORRECTION

PATENT NO. : 4,906,545

DATED : MARCH 6, 1990

INVENTOR(S) : Toshio FUKAGAI et al

It is certified that error appears in the above-identified patent and that said Letters Patent is hereby corrected as shown below:

Column 38, line 18, change "mill" to -- milled --.

Column 43, line 38, change "mill" to -- milled --.

Column 45, line 63, change "replaced" to -- replacing --.

Column 46, line 63, change "99.9%" to -- 99.99% --.

Column 48, line 4, after "to", insert -- test --;

line 29, in Table 2 at $V'_2$ and comparative example # 9, change "-510" to -- -710 --.

Signed and Sealed this

Twenty-eighth Day of July, 1992

*Attest:*

DOUGLAS B. COMER

*Attesting Officer*

*Acting Commissioner of Patents and Trademarks*